US008601699B2

(12) United States Patent
Vellekamp

(10) Patent No.: US 8,601,699 B2
(45) Date of Patent: Dec. 10, 2013

(54) LOCKING-FOLDING UTILITY KNIFE

(75) Inventor: Isaac Vellekamp, Puyallup, WA (US)

(73) Assignee: Blade-Tech Industries, Inc., Puyallup, WA (US)

( * ) Notice: Subject to any disclaimer, the term of this patent is extended or adjusted under 35 U.S.C. 154(b) by 443 days.

(21) Appl. No.: 12/455,120

(22) Filed: May 27, 2009

(65) Prior Publication Data

US 2010/0299933 A1 Dec. 2, 2010

(51) Int. Cl.
*B26B 3/06* (2006.01)

(52) U.S. Cl.
USPC ..... 30/155; 30/160; 30/161; 30/162

(58) Field of Classification Search
USPC ..... 30/161, 154, 158, 169, 2, 155, 159, 30/160, 162; D8/98, 99
See application file for complete search history.

(56) References Cited

U.S. PATENT DOCUMENTS

| | | | | | |
|---|---|---|---|---|---|
| 338,853 | A * | 3/1886 | Marks | 30/143 |
| 601,380 | A * | 3/1898 | Phillips | 81/3.35 |
| 1,079,300 | A * | 11/1913 | Littleton et al. | 30/118 |
| 2,071,562 | A * | 2/1937 | Nelson | 30/154 |
| 2,107,736 | A * | 2/1938 | Huber | 30/162 |
| 2,814,864 | A * | 12/1957 | Zevely et al. | 30/2 |
| 2,869,232 | A * | 1/1959 | Kivela | 30/161 |
| 2,940,170 | A * | 6/1960 | Matter | 30/293 |
| 3,518,758 | A * | 7/1970 | Bennett | 30/154 |
| 4,265,017 | A * | 5/1981 | Collins | 30/162 |
| 4,663,845 | A | 5/1987 | Weimann | |
| 4,761,882 | A | 8/1988 | Silverstein | |
| 4,936,014 | A | 6/1990 | Shannan et al. | |
| 4,941,260 | A | 7/1990 | Castelluzzo | |
| 6,052,908 | A | 4/2000 | Harman | |
| 6,161,290 | A | 12/2000 | Takamasa | |
| 6,205,667 | B1 * | 3/2001 | Glesser | 30/162 |
| 6,263,581 | B1 | 7/2001 | Forte | |
| 6,513,246 | B2 | 2/2003 | Ping | |
| 6,598,301 | B2 * | 7/2003 | McCool et al. | 30/321 |
| 6,732,436 | B2 * | 5/2004 | Moizis | 30/155 |
| D584,934 | S * | 1/2009 | Feliciano | D8/95 |

* cited by examiner

*Primary Examiner* — Omar Flores Sanchez
(74) *Attorney, Agent, or Firm* — Wolfe-SBMC

(57) ABSTRACT

A utility knife includes a handle having a blade track system with a pivot point and a blade mounted in the blade track system. The blade includes a cutting/scraping edge extending along a side of the blade. In an implementation, the blade is shiftable between a closed configuration, where the cutting/scraping edge is enclosed within the handle, to a first open configuration, where the blade extends longitudinally outward from an end of the handle. The shift between the closed and first open configurations can occur by rotating the blade about the pivot point and in the blade track system. Also, the blade is shiftable along the blade track system between the first open configuration and a second open configuration, where the blade is located towards another end of the handle such that the cutting/scraping edge extends downwards from a bottom of the handle.

14 Claims, 4 Drawing Sheets

LOCKING-FOLDING UTILITY KNIFE

FIELD OF THE INVENTION

This invention relates to utility knives, and specifically to a utility knife in which the blade both folds into a handle and when opened, locks into an operation position.

BACKGROUND OF THE INVENTION

Utility knives are known to those of ordinary skill in the art to have many forms, everything from the simple box cutter with a fixed, exposed blade, to machete-style implements. Utility knives with slidable blades are described in U.S. Pat. No. 4,663,845 to Weimann, U.S. Pat. No. 4,761,882 to Silverstein, U.S. Pat. No. 4,941,260 to Castelluzzo, U.S. Pat. No. 6,161,290 to Takamasa, and U.S. Pat. No. 6,513,246 B2 to Ping. A utility knife having both a folding and slidable blade is described in U.S. Pat. No. 4,936,014 to Shaanan et al. U.S. Pat. No. 6,263,581 B1 to Forte describes a hunting utility knife which has a folding, curved blade wherein blade edges are replaceable/interchangeable. U.S. Pat. No. 6,052,908 to Harman describes a utility knife useful for skinning game, which has a curved edge.

For all of the inventiveness which precedes the instant invention, there has not been described a utility knife which provides variable blade positions and which allows the blade to be folded into a carrying position.

SUMMARY OF THE INVENTION

A utility knife includes an elongate handle having a blade track system therein, the blade track system having a blade pivot point therein; an elongate blade mounted in the blade track system, the blade having a blade slot extending along a majority of its length, and a sharpened cutting/scraping edge extending along a side of the blade; wherein the blade is shiftable between a closed configuration, wherein the cutting/scraping edge is enclosed within the handle, to a first open configuration by rotating about the blade pivot point and in the blade track system, wherein the blade extends longitudinally outward from an end of the handle, and wherein the blade is shiftable along the blade track system between the first open configuration and a second open configuration wherein the blade is located towards another end of the handle and extends downwards from a bottom of the handle.

It is an object of the invention to provide a utility knife which has both a folding and lockable blade, wherein the blade may be locked into plural positions.

Another object of the invention is to provide a utility knife which is convertible into a chopping configuration.

A further object of the invention is to provide a utility knife which is convertible into a scraping configuration.

This summary and objectives of the invention are provided to enable quick comprehension of the nature of the invention. A more thorough understanding of the invention may be obtained by reference to the following detailed description of the preferred embodiment of the invention in connection with the drawings.

DETAILED DESCRIPTION OF THE PREFERRED EMBODIMENTS

Figure 1:
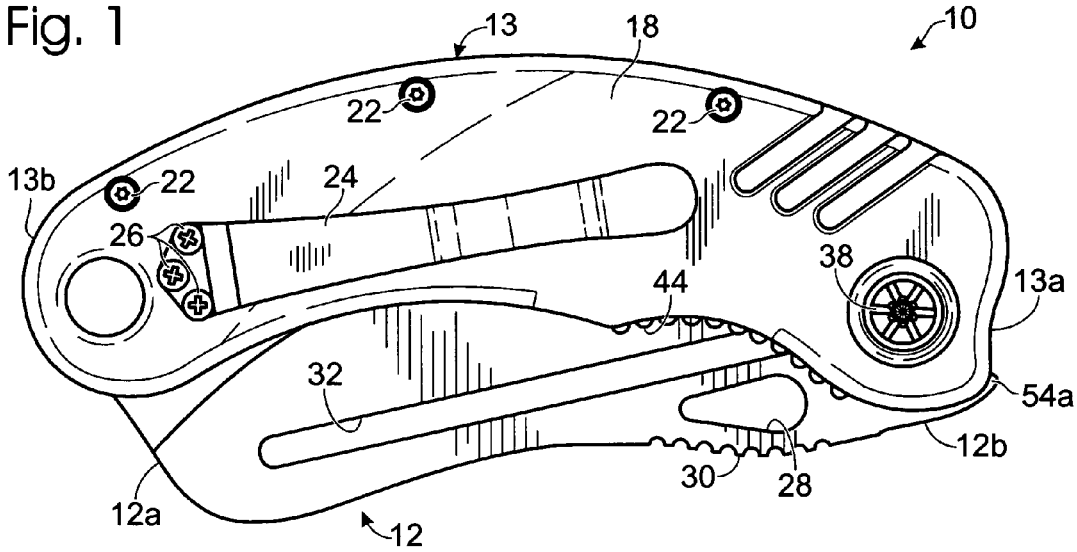
FIG. 1 depicts the utility knife of the invention in a closed, carrying configuration.

Referring now to FIGS. 1-4, the locking-folding utility knife of the invention is depicted generally at 10. Knife 10 includes an elongate blade 12, which is pivotally and slidably mounted in a handle 13, which includes a right side plate 14 and a left side plate 16, a right handle slab 18 fixed to right side plate 14 and a left handle slab 20 fixed to left side plate 16, by means of fasteners, such as screws 22. In the preferred embodiment, side plates are about 1/16 inch thick and formed of a high-grade steel. As depicted in the drawing figures, side plates 14, 16 have wasted area 14*a*, 16*a*, respectively, formed therein to reduce the weight of the finished knife. Also, in the preferred embodiment, the handle slabs are formed of polymer-coated aluminum. Handle 13 has an open construction, as will be explained later herein, to facilitate cleaning. A pocket clip 24 is affixed to right handle slab 18 by means of fasteners, such as screws 26. The knife is shown in a closed configuration in FIG. 1, and depicted in a first open configuration in FIGS. 2-4, which first open configuration is referred to herein as a chopping configuration.

The locking-folding utility knife of the invention allows a user to rotate blade 12 out of handle 13 and into a first open configuration, wherein the blade locks into a position where the blade extends longitudinally outward from the handle. In this configuration, the utility knife may be used for cutting and chopping. Blade 12 may be shifted to a second open configuration where blade 12 extends downwards from the bottom of handle 13, with the blade locked into this second open position, where the utility knife may be used as a scraper, as in scraping hides during a game skinning process. The blade may be shifted back to its first open position and then folded back into handle 13 for safe transporting.

Figure 2:
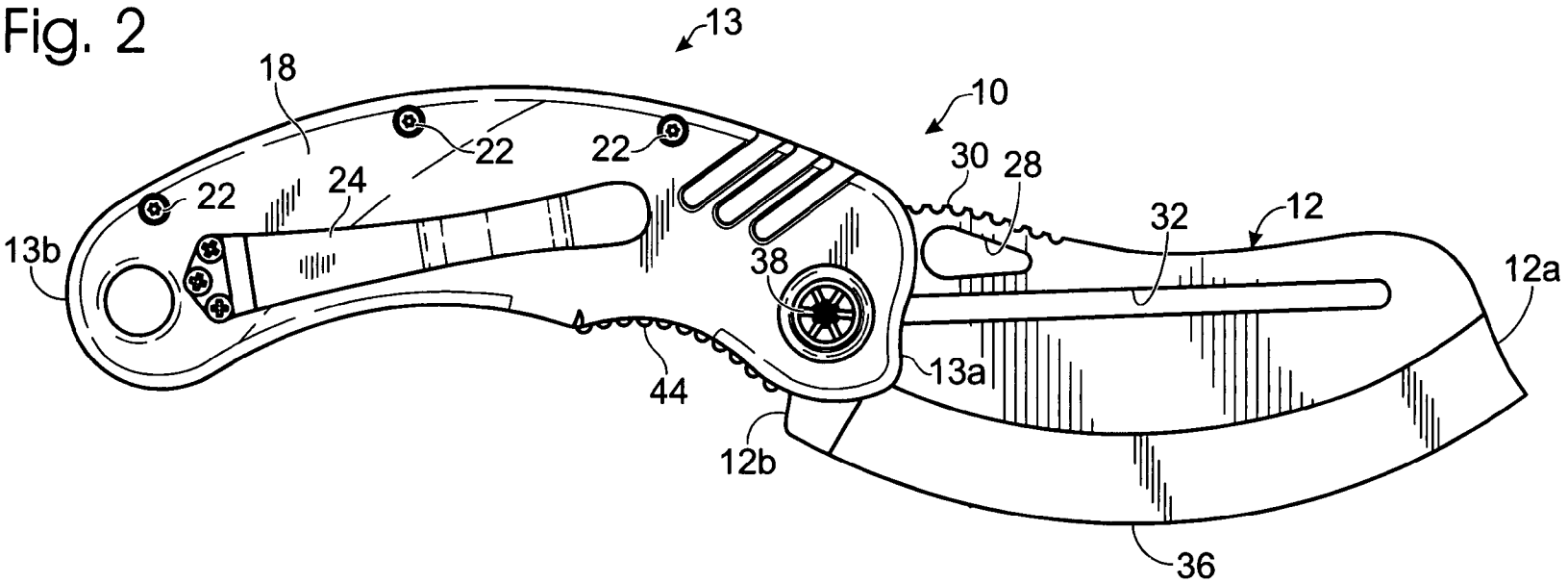
FIG. 2 is a side elevation of the knife of FIG. 1 in a first open, chopping configuration.
Figure 3:
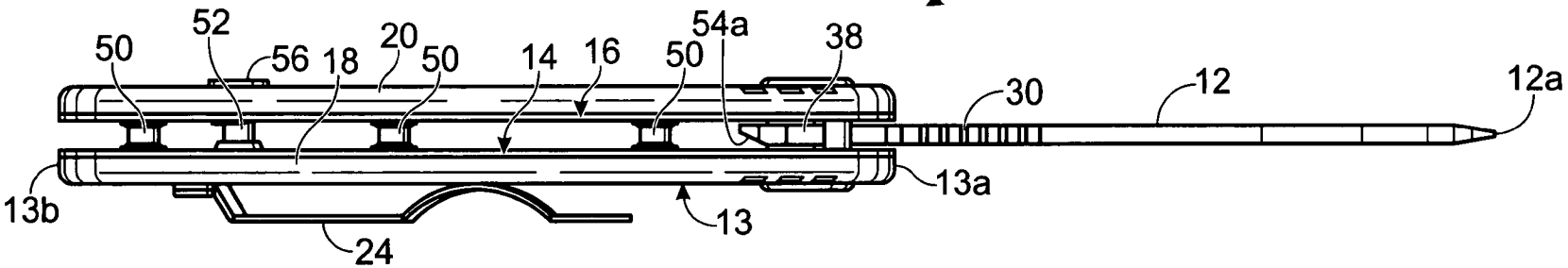
FIG. 3 is a top plan view of the knife of FIG. 1 in its first, open, chopping configuration.
Figure 4:
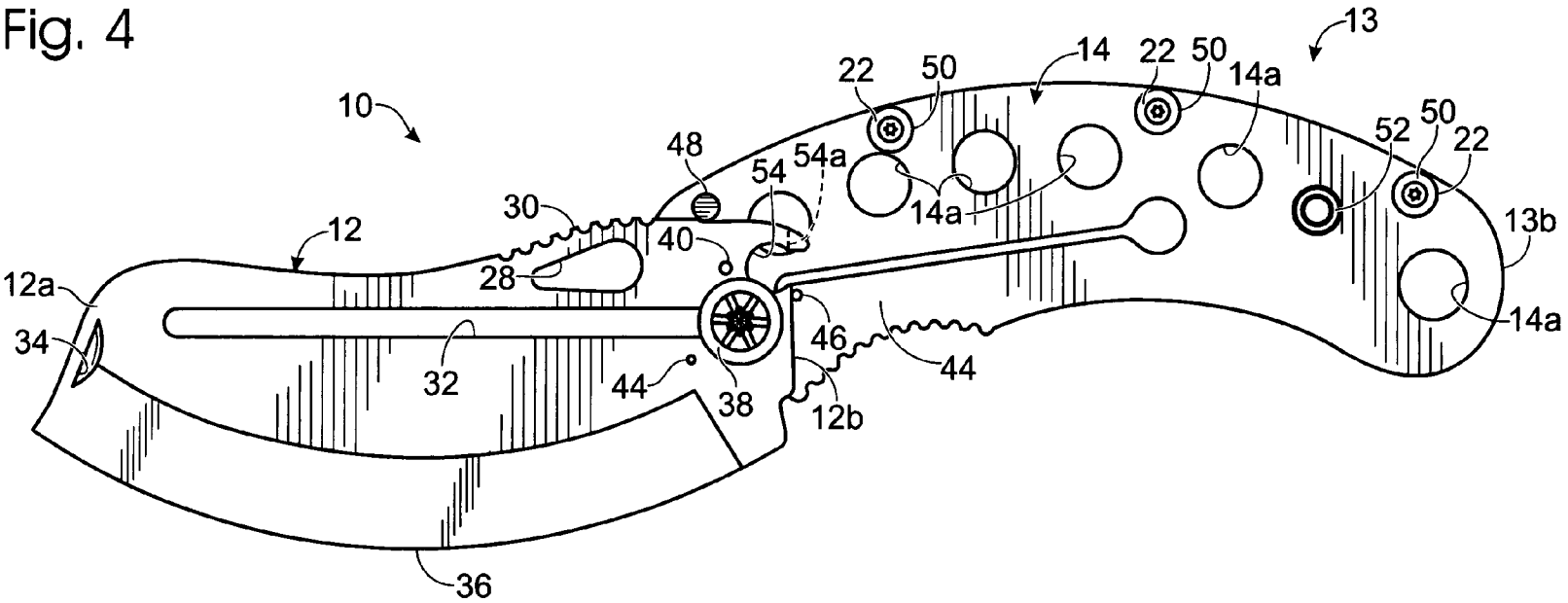
FIG. 4 is a side elevation of the knife of FIG. 1 (horizontally flipped) in a first open, chopping configuration, with the right handle slab and side plate removed to show detail.
Figure 7:
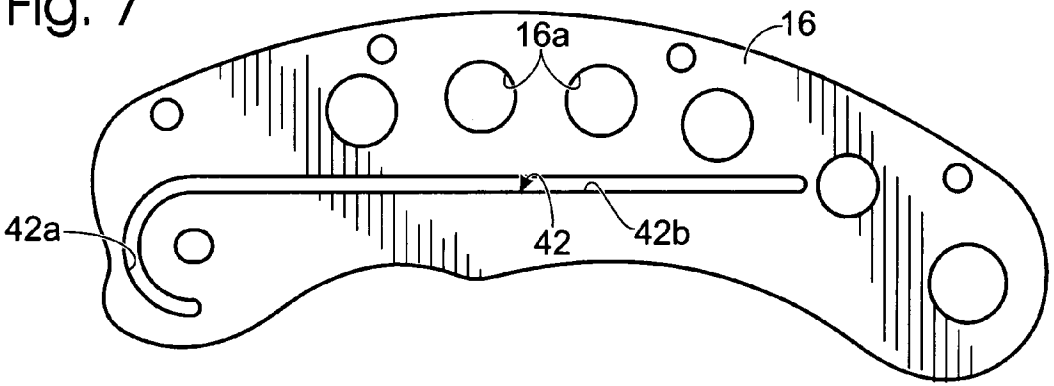
FIG. 7 is a side elevation of a right side plate of the knife of FIG. 1.

Referring now to FIGS. 2-4, blade 12 includes a thumb hole 28 to facilitate opening of the blade. A notched blade choil 30 is provided to improve control of the blade when in its first opened configuration. A blade slot 32, extending along a majority of the length of blade 12 from adjacent one end 12*a* of blade 12 to adjacent another end 12*b* of blade 12 allows for shifting of blade 12 from its first open configuration to a second, open, or scraping, configuration, which operation will be explained in greater detail later herein. A thumb notch 34 is provided to assist in shifting from one configuration to another. Blade 12 includes an arcuate, sharpened cutting/scraping edge 36. A blade pivot pin 38 defines a blade pivot point and secures blade 12 between side plates 14, 16 and is received in blade slot 32, thus, blade 12 rides on blade pivot pin 38 when shifting between configurations. Pivot pin 38 is located adjacent one end 13*a* of handle 13. A blade travel pin 40 is located above blade slot 32 adjacent the other end 12*b* of blade 12, and is received in a travel groove 42 formed in left side plate 16, shown in FIG. 7. As seen in FIG. 7, travel groove 42 has a j-shaped configuration, with a hook 42*a* of the "J"

located adjacent one end 13*a* of handle 13, and a staff 42*b* of the "J" extending longitudinally towards another, or aft, end 13*b* of handle 13. Blade slot 32 and blade pivot pin 38, along with travel groove 42 and travel pin 40 comprise what is referred to herein as a blade track system.

Right side plate 14 contains a blade locking mechanism, which includes a blade lock 44, a lock pin 46 and a stop pin 48, collectively referred to herein as a first lock interface, which also includes a detent 49 on blade 12. Blade lock 44, formed by a cut in side plate 14, is slightly bend inwards, and includes an array of notches to insure adequate friction between the blade lock and a user's digit. Blade lock 44 abuts blade other end 12*b*, preventing movement of blade 12 relative handle 13 when the blade is in its first open configuration. When blade 12 is closed, lock pin 44 is received in detent 49, which maintains blade 12 in its closed position.

Side plates 14, 16 are fastened together by screw fasteners 22 and are spaced apart from one another, i.e., spatially maintained, by spacer posts 50, or spacers, which extend on fasteners 22 between the side plates to provide the aforementioned open construction of handle 13. Blade 12 occupies a part of the space between the side plates.

Figure 6:
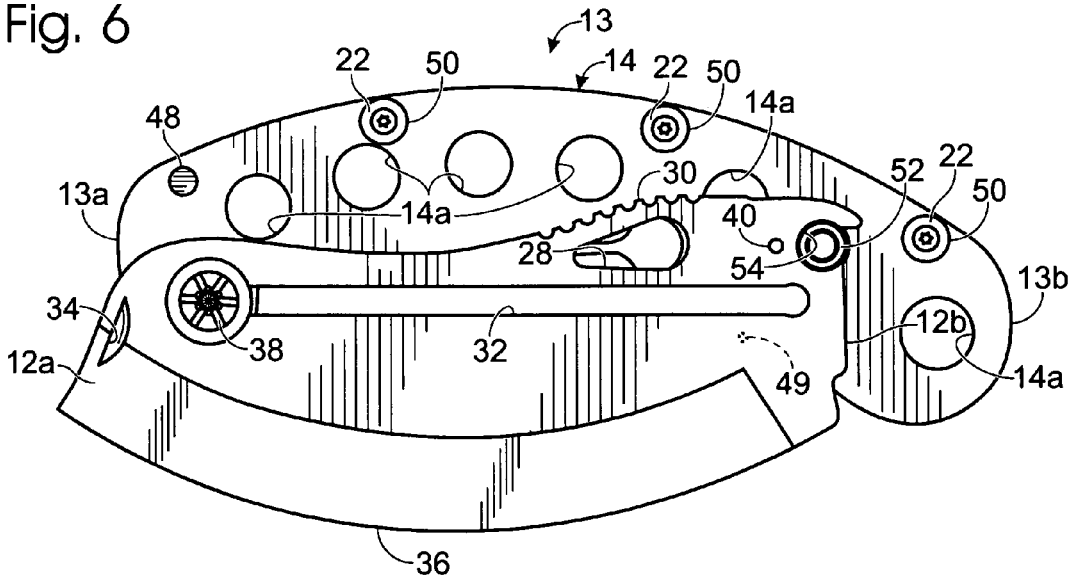
FIG. 6 is a side elevation of the knife of FIG. 4 in its second open, scraping configuration.
Figure 5:
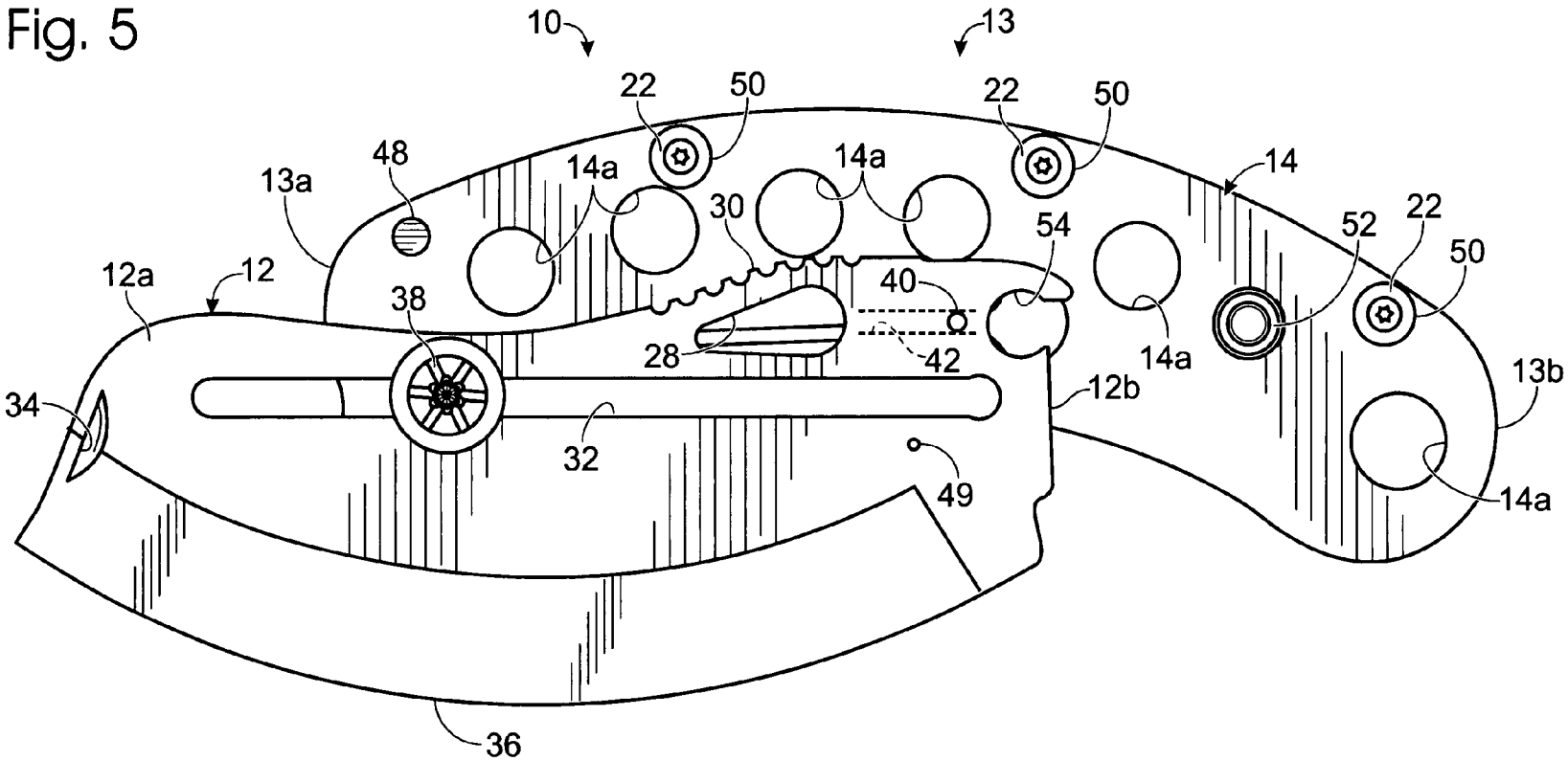
FIG. 5 is a side elevation of the knife of FIG. 4 in an intermediate configuration, between the first chopping configuration and a second open, scraping configuration.

Referring now to FIG. 5, blade 12 is depicted in an intermediate configuration. This configuration is reached from the first open configuration by pressing blade lock 44 to align with the remainder of side plate 14 and shifting blade 12 aft, towards the rear, or other end 13*b*, of handle 13. Blade 12 travels on blade pivot pin 38 while travel pin 40 moves in travel groove 42. When the blade reaches its full aft travel, a lock receiver 54 receives a spring lock 52, fixing blade 12 in its second, scraping configuration, depicted in FIG. 6. Lock receiver 54 has a ramp 54*a* which facilitates engagement of spring lock 52, which is displaced towards side plate 16 as blade 12 is shifted aft to its second open configuration, and which then drops into lock receiver 54, fully being seated in the receiver to prevent any movement of blade 12 relative to handle 13 in the second open position. In this configuration, blade pivot pin 38 is located fully forward in blade slot 32. Spring lock 52 and receiver 54 comprise what is referred to herein as a second locking interface, which is located adjacent other end 13*b* of handle 13. Blade 12 is released from its locked second open configuration by pressing a lock release 56, shown in FIG. 3, allowing blade 12 to be pulled forward, facilitated by thumb notch 34, to its first open position, from which, with sideways movement of blade lock 44, the blade may be rotated to its closed position. When in its closed configuration, knife 10 has a length of about 4⅞ inches. When knife 10 is in its first open configuration, with the blade fully extended, knife 10 has a length of about 8⅝ inches, while, with the knife in its second open configuration, it has a length of about 5¼ inches.

Thus, a multi-function utility knife has been disclosed. It will be appreciated that further variations and modifications thereof may be made within the scope of the invention as defined in the appended claims.

I claim:

1. A utility knife comprising:

an elongate handle having a blade track system comprising a blade pivot point, a slot, and a pivot pin, the pivot pin located at said pivot point and configured to be received in said slot, said blade track system further comprising a travel groove located in a side plate having a travel pin, the travel pin being slidably receivable in said travel groove; and an elongate blade mounted in said blade track system, said blade having a sharpened cutting/scraping edge extending along a side of the blade;

wherein said blade is shiftable between a closed configuration and a first open configuration by rotating said blade about said pivot point and in said blade track system, the closed configuration comprising said cutting/scraping edge enclosed within said handle, the first open configuration comprising said blade extending longitudinally outward from a first handle end of said handle, said blade being slidably deployable along said blade track system between said first open configuration and a second open configuration, the second open configuration comprising said blade being disposed substantially in line with said handle such that the cutting/scraping edge is exposed and disposed directly opposite a side of said handle that is configured to regress in a user's hand.

2. The utility knife of claim 1 wherein said handle includes a pair of spaced apart side plates that include said side plate, wherein said first open configuration includes a first blade end extending longitudinally outward from said first handle end of said handle and a second blade end being received in said first handle end, said handle further including a first locking interface for locking said blade in said first open configuration, said first locking interface including a blade lock formed in one of said side plates and configured to engage said second blade end to lock said blade relative to said handle in said first open configuration.

3. The utility knife of claim 1 wherein said handle includes:

a pair of spaced apart side plates that include said side plate;

a second handle end opposing said first handle end; and a spring lock extending between the side plates adjacent said second handle end.

4. The utility knife of claim 1 wherein said handle includes spaced apart side plates that include said side plate and which comprise an open configuration, wherein said side plates are partially maintained by spacers secured between said side plates.

5. The utility knife of claim 1 wherein said travel groove includes a J-shaped configuration, said travel pin being configured to move through a hook of the J when said blade is shifted between said closed configuration and said first open configuration, and wherein said travel pin is configured to move along a staff of the J when said blade is deployed between said first open configuration and said second open configuration.

6. The utility knife of claim 1 wherein said sharpened cutting/scraping edge has an arcuate perimeter.

7. A utility knife comprising:

an elongate handle having a blade track system comprising a pivot point, said handle including opposing first and second handle ends located at opposing ends of a longitudinal axis;

an elongate blade mounted in said blade track system, a sharpened cutting/scraping edge extending along a side of the blade, and the pivot point located at one of a first blade end of said blade or a first handle end of said handle;

said blade being shiftable between a closed configuration and a first open configuration by rotating said blade about said pivot point and in said blade track system, the closed configuration including the sharpened cutting/scraping edge enclosed within said handle, the first open configuration including said blade extending longitudinally outward from the first handle end of said handle, said blade being slidably shiftable along said blade track system substantially parallel to a longitudinal axis to shift said blade between said first open configuration and a second open configuration, the second open configuration including the first blade end being disposed proximate the second handle end of said handle and a second blade end being disposed proximate the first handle end, the second open configuration further comprising the sharpened cutting/scraping edge being exposed; and said blade track system comprising:

a pivot pin usable to rotate said blade between the closed configuration and the first open configuration;

a slot configured to receive the pivot pin; and a travel groove configured to slidably receive a travel pin and usable to slidably shift said blade between the first open configuration and the second open configuration.

8. The utility knife of claim 7 wherein said handle includes a pair of spaced apart side plates.

9. The utility knife of claim 7 wherein said handle includes spaced apart side plates which comprise an open configuration, wherein said side plates are partially maintained by spacers secured between said side plates.

10. The utility knife of claim 9 wherein said travel groove has a J-shaped configuration, wherein said travel pin is configured to move through a hook of the J when said blade is shifted between said closed configuration and said first open configuration, and wherein said travel pin is configured to move along a staff of the J when said blade is shifted between said first open configuration and said second open configuration.

11. The utility knife of claim 7 wherein said sharpened cutting/scraping edge has an arcuate perimeter.

12. A utility knife comprising:

a closed configuration including a blade having a sharpened edge enclosed within a handle, the blade having opposing first and second blade ends, the handle having opposing first and second handle ends, the first blade end disposed proximate a first handle end;

a first open configuration including the blade extending longitudinally outward from the first handle end and the first blade end disposed proximate the first handle end, the blade configured to rotate about a pivot pin to shift between the closed configuration and the first open configuration; and a second open configuration including the sharpened edge of the blade being exposed and being substantially in line with the handle, the second open configuration further comprising a locking mechanism to lock the first blade end proximate the second handle end, the locking mechanism including a spring lock and a lock receiver configured to receive a spring lock, the blade being slidably received at the second open configuration from the first configuration along a blade track system, the blade track system configured to guide the blade when the blade is slidably shifted between the first and second open configurations, the blade track system comprising a travel groove formed in a J-shaped configuration and a travel pin that is configured to:

move along a hook of the J of the travel groove when the blade is shifted between the closed configuration and the first open configuration; and move along a staff of the J of the travel groove when the blade is slidably shifted between the first open configuration and the second open configuration.

13. The utility knife of claim 12, wherein the sharpened edge of the blade includes an arcuate perimeter.

14. The utility knife of claim 12, further comprising:

a first locking interface configured to lock the blade in the first open configuration or the closed configuration, the first locking interface including a blade lock, a lock pin, and a stop pin, wherein the first locking interface is disposed proximate the first handle end; and a second locking interface including the spring lock and the lock receiver to lock the blade in the second open configuration, wherein the second locking interface is disposed proximate the second handle end.

* * * * *